United States Patent [19]

Juston et al.

[11] Patent Number: 5,050,478

[45] Date of Patent: Sep. 24, 1991

[54] RAILGUN STRUCTURE FOR ENHANCED PROJECTILE VELOCITY

[75] Inventors: John M. Juston, Yellow Springs; John P. Barber, Dayton, both of Ohio

[73] Assignee: IAP Research, Inc., Dayton, Ohio

[21] Appl. No.: 441,527

[22] Filed: Nov. 27, 1989

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 3,417,273 | 12/1968 | Gates et al. | 313/63 |
| 3,613,499 | 10/1971 | Hubbard | 89/8 |
| 3,848,313 | 11/1974 | Guyonnet | 29/191.2 |
| 3,916,761 | 11/1975 | Fletcher et al. | 89/8 |
| 4,010,396 | 3/1977 | Ress et al. | 313/231.3 |
| 4,157,054 | 6/1979 | Cobb | 89/8 |
| 4,334,474 | 6/1982 | Coltharp | 102/206 |
| 4,343,223 | 8/1982 | Hawke et al. | 89/8 |
| 4,433,608 | 2/1984 | Deis et al. | 89/8 |
| 4,437,383 | 3/1984 | Deis et al. | 89/8 |
| 4,485,720 | 12/1984 | Kemeny | 89/8 |
| 4,555,972 | 12/1985 | Heyne | 89/8 |
| 4,577,545 | 3/1986 | Kemeny | 89/8 |
| 4,590,842 | 5/1986 | Goldstein et al. | 89/8 |
| 4,621,577 | 11/1986 | Bickes, Jr. et al. | 102/200 |
| 4,706,542 | 11/1987 | Hawke | 89/8 |

OTHER PUBLICATIONS

Marshall, Richard A., "Plasma Puffing from a Railgun Armature", IEEE Transactions on Magnetics, vol. MAG-20, No. 2, Mar. 1984, pp. 264–267.

Department of Defence, Defence Science and Technology Organisation Materials Research Laboratories, Melbourne, Victoria, Australia, "Evaluation of Capel, A Novel Railgun Concept", by G. A. Clark.

"Feasibility Study of a Railgun as a Driver for Impact Fusion", Westington R & D Center, Pittsburgh, Pa.

Hybrid Electromagnetic Launchers for Large Projectiles: Method to Combine EML and Rocket Propulsion Concepts, K. W. Chen, S. Mattay and G. Leyh.

The Electromagnetic Rocket Gun—A Novel Launch Concept, F. Winterberg.

Ablation Controlled Arcs, IEEE Transactions on Plasma Science, vol. PS-14, No. 4, Aug. 1986.

Ablation-Stabililzed Arcs in Nylon and Boric Acid Tubes, IEEE Transactions on Plasma Science, vol. PS-15, No. 3, Jun. 1987.

Electromagnetic Acceleration of Macroparticles to High Velocities, S. C. Rashleigh and R. A. Marshall, Apr. 1978.

*Primary Examiner*—Stephen C. Bentley

*Attorney, Agent, or Firm*—Jacox & Meckstroth

[57] ABSTRACT

Railgun structure having a pair of spaced-apart electrically conductive rails. A source of electrical energy is connected to the rails. An armature vessel is positioned between the rails and is movable along the rails. The armature vessel contains an electrically conductive plasma or gas through which electrical current flows when the rails are electrically energized. When electrical current flows through the plasma or gas, the pressure of the plasma or gas within the armature vessel becomes very high. At least one of the rails is provided with a series of vent apertures along the length thereof. The armature vessel has an opening therein which comes into communication with the vent apertures as the armature vessel travels along the rails. Thus, a portion of the plasma or gas is released through the vent apertures, and the pressure within the armature vessel is controlled. Therefore, the armature vessel travels at a very high velocity. Thus, the armature vessel is capable of moving a projectile at a very high velocity.

21 Claims, 1 Drawing Sheet

RAILGUN STRUCTURE FOR ENHANCED PROJECTILE VELOCITY

The invention described herein may be manufactured and used by the Government of the United States for all governmental purposes without the payment of any royalty.

BACKGROUND OF THE INVENTION

Several embodiments of railguns have been developed. The basic railgun includes a pair of electrically conductive rails, with an armature and a projectile between the rails. When an electric current is applied to the rails the armature travels at a high velocity along the rails and forces the projectile to travel at a high velocity along the rails and from the rails.

Solid metallic conductor armature elements have been used. However, a solid metallic conductor armature has limitations which result from sliding and current resistive contacts between the armature and the rails.

Plasma armatures have been found to be preferable over solid metallic conductor armatures. Plasma readily maintains contact with the rails. However, projectiles which are accelerated by plasma armatures in railguns reach a velocity limit. This limit in projectile velocity occurs as a result of factors which are developed which oppose the net acceleration forces.

One of the principal factors which oppose the net acceleration forces involves current restrike. Current restrike occurs when current flow is initiated behind the plasma armature Restrike occurs when the voltage standoff capacity between the rails is exceeded and voltage breakdown occurs. The electromagnetic forces applied to the armature are proportional to the square of the current through the plasma armature. When restrike occurs, a secondary current path is developed behind the plasma armature. Therefore, the magnitude of current flow through the plasma armature is reduced. Thus, the accelerating force applied to movement of the plasma armature is reduced significantly.

In an attempt to reduce the possibility of current restrike, confined plasma armatures have been employed. In a confined plasma armature the plasma is confined within a high-strength, light weight, pressure vessel which is movable along the rails. A confined plasma armature maintains a much higher current conductivity, thus requiring less plasma mass to conduct the current. The decrease in mass of the plasma decreases the viscous drag which occurs between the plasma and the rails.

A major problem exists with regard to a confined plasma armature. As a result of the high current flow through the plasma, the plasma temperature becomes very high, and substantially everything contacted by the plasma is melted. Much of the melted material vaporizes and adds to the plasma pressure within the vessel. Therefore, the gaseous pressure within the armature vessel becomes excessive, and means must be provided for controlling the high gaseous pressure.

One method of control of the pressure within the armature vessel has been that of permitting portions of the plasma to be vented from the armature vessel into the space behind the armature vessel and between the rails. In such release of plasma between the rails there is a tendency for restrike of the current between the rails. As stated above, any restrike of current causes a reduction in the forces exerted by the armature upon the projectile. Therefore, this method is not satisfactory.

It is thus an object of this invention to provide railgun structure and a method in which a plasma armature is employed and in which the tendency for current restrike does not occur or is minimal.

It is another object of this invention to provide railgun structure and a method which are capable of enhanced projectile velocity.

It is another object of this invention to provide railgun structure which includes electrically conductive gaseous material and in which the pressure of the electrically conductive gaseous material is controlled.

It is another object of this invention to provide railgun structure which includes electrically conductive gaseous material and in which the electrical conductivity of the electrically conductive material is controlled.

It is another object of this invention to provide such railgun structure and a method in which efficiency of operation is enhanced.

Other objects and advantages of this invention reside in the construction of parts, the combination thereof, the method of construction and the mode of operation, as will become more apparent from the following description.

SUMMARY OF THE INVENTION

Railgun structure of this invention comprises a bore which includes a pair of rails. The bore has a breech portion and a muzzle portion. Means are provided for applying high current electrical energy to the rails. A projectile is positioned between the rails and between the breech portion and the muzzle portion. A high strength armature vessel is positioned adjacent the projectile and between the projectile and the breech. Within the armature vessel is an electrically conductive plasma or gaseous material.

When electrical energy is applied to the rails an electrical current flows through the rails and through the plasma in the armature vessel. The electrical energy is capable of forcing a high magnitude of electrical current through the rails and through the plasma within the armature vessel. Thus, the armature vessel travels at a high velocity toward the muzzle portion of the bore, and the armature vessel moves the projectile at a high velocity toward the muzzle portion of the bore.

The temperature of the plasma within the armature vessel rapidly reaches a very high value, and plasma or gas pressure within the armature vessel rapidly reaches a very high value. The armature vessel and bore structure are capable of withstanding very high pressures, but maximum pressures are experienced. Therefore, an equilibrium pressure is maintained within the armature vessel. The pressure within the armature vessel tends to increase as the armature vessel and projectile travel along the rails and along the bore. In order to maintain an equilibrium pressure within the armature vessel, a portion of the gases within the armature vessel is released as the pressure within the armature vessel tends to increase.

In the railgun structure of this invention, means are provided for venting the gases from the armature vessel and from the bore. Preferably at least one of the rails between which the armature and projectile travel is provided with a series of vent apertures. The series of apertures extends along the rails. The armature vessel has opposed end portions which engage the rails between which the armature vessel travels.

The armature vessel has at least one opening therein which is moved into communication with the vent apertures as the armature vessel travels along the rails. Thus, a portion of the gases within the armature vessel is released through the vent apertures as the armature vessel moves along the rails. The flow of a portion of the gases from the vessel, &through the vent apertures and from the bore permits the gas pressure within the vessel to be maintained at a desired pressure state. Preferably, the pressure state is an equilibrium pressure state. The equilibrium pressure state is preferably the maximum pressure state of the railgun structure. The equilibrium pressure state is influenced, inter-alia, by the density of the current flow through the gases in the armature vessel and by the size of the vent apertures in the rails and by the spacing between adjacent vent apertures in the rails.

Also, the electrical conductivity of the electrically conductive gaseous material is controlled as the pressure of the electrically conductive gaseous material is controlled.

DETAILED DESCRIPTION OF THE PREFERRED EMBODIMENT

Figure 1:
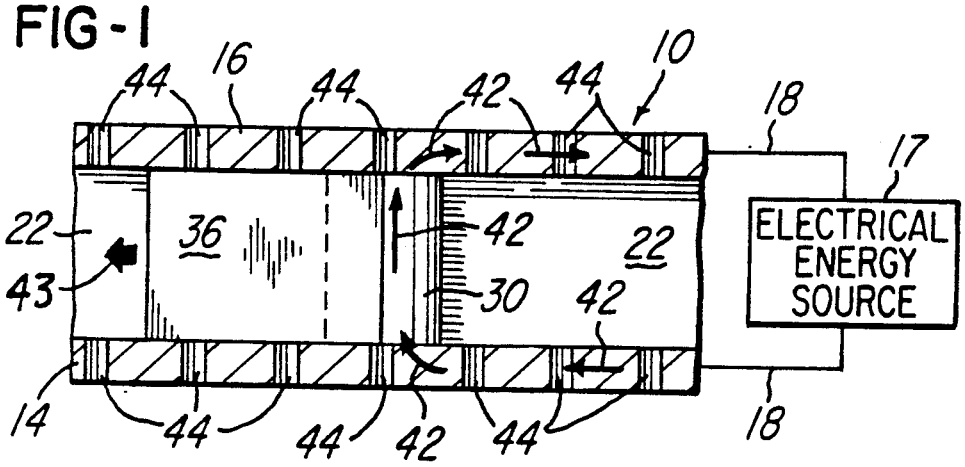
FIG. 1 is a diagrammatic type of top sectional view illustrating railgun structure of this invention.

FIG. 1 illustrates diagrammatically railgun structure 10 of this invention. The railgun structure 10 of this invention comprises a gun bore which includes rails 14 and 16. A source 17 of direct current electrical energy is joined to the rails 14 and 16 by means of electrical conductors 18. Between the rails 14 and 16, and as a part of the gun bore is a floor 22 of electrical insulator material. Between the rails 14 and 16 and above the floor 22 is an armature vessel 30 and a projectile 36. Within the armature vessel 30 is a material which, when heated, forms an electrically conductive gas or plasma 40. Above the rails 14 and 16, and as a part of the gun bore is a cover member 41.

As electrical energy is applied to the rails 14 and 16 from the electrical energy source 17, electrical current flows into the rail 14. The electrical current then flows from the rail 14, into the plasma 40, through the armature vessel 30 and from the plasma 40 into the rail 16. The flow of electrical current is illustrated by arrows 42 in FIGS. 1 and 3. As a result of this flow of electrical current the armature vessel 30 travels at a high velocity along the rails 14 and 16 in the direction indicated by an arrow 43. The armature vessel 30 forces the projectile 36 to travel at a high velocity along the rails 14 and 16. The armature vessel 30 engages the rails 14 and 16 in a manner such that the plasma 40 does not leak out from the armature vessel 30 between the armature vessel 30 and the rails 14 and 16. As electrical current flows through the plasma 40, the pressure of the plasma 40 within the armature vessel 30 becomes very high.

Figure 2:
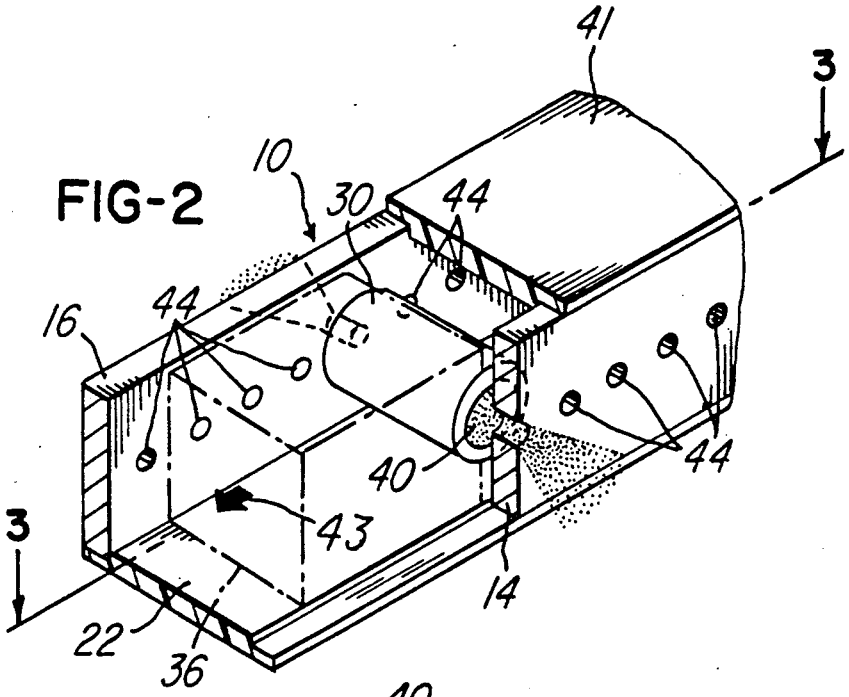
FIG. 2 is a perspective view illustrating operation of a railgun of this invention.
Figure 3:
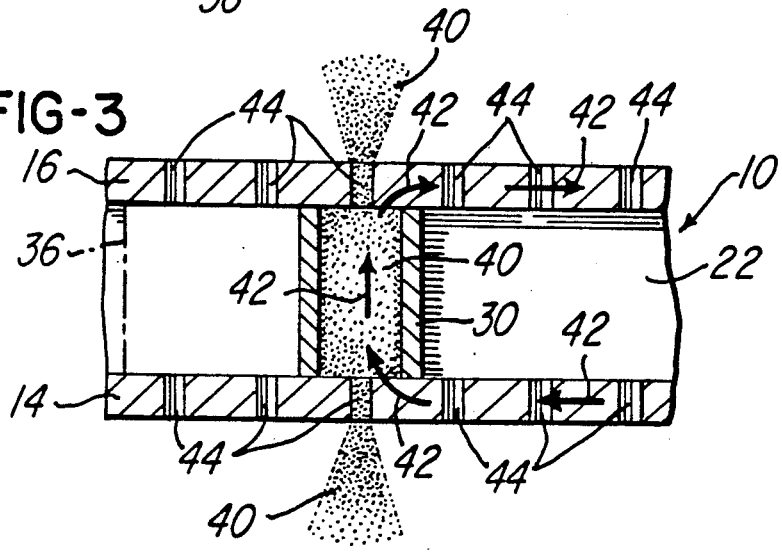
FIG. 3 is a sectional view taken substantially on line 3—3 of FIG. 2.

In this invention, as illustrated in the figures of the drawings, in order to exhaust gases or plasma from the bore, each of the rails 14 and 16 is provided with a series of vent apertures 44 therein. However, under some conditions, only one of the rails 14 and 16 may be provided with vent apertures 44 therein. The series of vent apertures 44 extends along the length of the rails 14 and 16. The armature vessel 30 has openings at the opposed ends which are moved into communication with the vent apertures 44 in the rails 14 and 16 as the armature vessel 30 travels along the rails 14 and 16. As the armature vessel 30 travels at a high velocity along the rails 14 and 16 and as the armature vessel 30 forces the projectile 36 to travel at a high velocity along the rails 14 and 16, some of the plasma 40 is permitted to flow outwardly from the armature vessel 30, through the openings in the armature vessel 30 and through the vent apertures 44, as illustrated in FIGS. 2 and 3.

Preferably, but not necessarily, the openings in the armature vessel 30 and the vent aperatures 44 in the rails 14 and 16 are so arranged and of predetermined areas that the openings in the armature vessel 30 are always in communication with at least one vent aperture 44 in the rails 14 and 16.

The area of the vent apertures 44 and the spacing between the vent apertures 44 is such that the pressure of plasma 40 is maximum in consideration of the physical features of the railgun structure 10 and without permitting leakage of the plasma 40 from the armature vessel 30, between the armature vessel 30 and the rails 14 and 16. Because there is no leakage of plasma from the armature vessel 30, between the armature vessel 30 and the rails 14 and 16, the possibility of restrike of the current outside the armature vessel 30 is eliminated.

Furthermore, because there is no leakage of plasma 40 between the armature vessel 30 and the rails 14 and 16 the area of contact of the plasma 40 within the rails 14 and 16 is minimum. Thus, the drag created by engagement of the plasma 40 with the rails 14 and 16 is minimal.

As electrical current flows through the plasma 40, a very high temperature is created within the plasma 40 and within the armature vessel 30. The high temperature plasma 40 radiates thermal energy into the walls of the armature vessel 30. The material of which the walls of the armature vessel 30 is constructed is heated and vaporizes, and the heat energy from the walls flows back into the armature vessel 30.

Thus, heat energy flows out of the armature vessel 30 with flow of portions of the plasma 40 from the armature vessel 30 through the vent apertures 44. As stated, the rate of flow of plasma 40 is controlled by the area of the vent apertures 44 and the spacing between the vent apertures 44. Thus, flow of the heat energy from the armature vessel 30 is maintained equal to the heat energy created within the armature vessel 30. Thus, in addition to gas pressure equilibrium, a thermodynamic equilibrium is maintained within the armature vessel 30 and between the rails 14 and 16.

The velocity of travel of the armature vessel 30 and the projectile 36 is dependent upon the density of the current flowing through the plasma 40 and armature vessel 30. Therefore, in this invention the current density through the plasma 40 is maintained at the highest possible level permitted in consideration of the physical features of the railgun structure 10.

Thus, the velocity of travel of the armature vessel 30 and the projectile 36 along the rails 14 and 16 is maximum, in consideration of the physical features related to the railgun structure 10.

Therefore, it is understood that railgun structure of this invention is structure by which maximum velocity of a projectile is possible in consideration of the physical features of the railgun structure.

Although the preferred embodiment of the railgun structure of this invention has been described, it will be understood that within the purview of this invention various changes may be made in the form, details, proportion and arrangement of parts, the combination thereof, and the mode of operation, which generally stated consist in a railgun structure within the scope of the appended claims.

The invention having thus been described, the following is claimed:

1. Railgun structure comprising a pair of electrically conductive rails, means for applying electrical energy to the rails, each of the rails being provided with a series of vent apertures extending along the length of the rails, a vessel positioned between the rails and in engagement therewith, the vessel having openings therein, means within the vessel forming an electrically conductive plasma within the vessel, whereby as electrical energy is applied to the rails electrical energy flows through the rails and through the plasma and the vessel travels at a high velocity along the rails, and whereby the plasma within the vessel reaches a high temperature and pressure, the openings in the vessel being moved into communication with the series of vent apertures as the vessel travels along the rails, and whereby gaseous pressure of the plasma within the vessel is controlled as portions of the plasma flow outwardly from the openings in the vessel and through the apertures in the rails as the vessel travels along the rails.

2. The railgun structure of claim 1 in which a projectile is positioned adjacent the vessel for movement of the projectile along the rails with movement of the vessel along the rails.

3. The railgun structure of claim 1 in which the area of the apertures in the rails and the spacing between the apertures are determined to maintain a desired gaseous pressure of the plasma within the vessel.

4. Railgun structure having a breech portion and a discharge portion comprising a pair of electrically conductive rails, at least one of the electrically conductive rails being provided with a series of vent apertures therein as the series extends between the breech portion and the discharge portion of the railgun structure, means for positioning an electrically conductive gaseous material between the rails, and means for applying electrical energy to the rails and to the electrically conductive gaseous material for movement of the electrically conductive gaseous material along the rails, whereby a portion of the electrically conductive gaseous material is released through the vent apertures in the rails as the electrically conductive gaseous material travels along the rails.

5. The railgun structure of claim 4 which includes a movable vessel for containing the electrically conductive gaseous material between the rails during movement of the electrically conductive gaseous material along the rails, the vessel being provided with at least one opening therein for flow of electrically conductive gaseous material therefrom and through the vent apertures.

6. The railgun structure of claim 4 which includes an armature vessel movable along the rails and containing the electrically conductive gaseous material within the armature vessel, the armature vessel having a portion which communicates with the vent apertures as the armature vessel is moved along the rails by the electrically conductive gaseous material, whereby a portion of the electrically conductive gaseous material is vented from the armature vessel through the vent apertures as the armature vessel travels along the rails.

7. The railgun structure of claim 4 in which the electrically conductive gaseous material includes an electrically conductive plasma.

8. Railgun structure comprising a pair of electrically conductive rails, each of the rails being provided with a series of spaced-apart vent apertures extending along the length of the rails, means for applying electrical energy to the rails, a vessel positioned between the rails and in sliding engagement therewith, the vessel being movable along the rails, the vessel being provided with openings therein which communicate with the vent apertures in the rails as the vessel travels along the rails, means within the vessel forming an electrically conductive plasma within the vessel, whereby as electrical energy is applied to the rails and to the plasma within the vessel the vessel travels at a high velocity along the rails, and whereby the gaseous pressure of the plasma within the vessel reaches a high value, and whereby the gaseous pressure of the plasma within the vessel is controlled as portions of the plasma flow outwardly from the vessel through the openings therein and through the vent apertures in the rails as the vessel travels along the rails.

9. The railgun structure of claim 8 in which the area of the openings in the vessel and the area and spacing of the vent apertures in the rails are such that the openings in the vessel are continuously in communication with the vent apertures as the vessel travels along the rails.

10. A method of producing railgun structure comprising providing a pair of electrically conductive rail members, forming a series of spaced-apart vent apertures in at least one of the rail members in which the series of vent apertures extends along the rail member, positioning the rail members in spaced-apart relationship, providing an armature vessel, forming an opening in the armature vessel, positioning the armature vessel between the rail members with the armature vessel being movable along the rails and with the opening in the armature vessel being in communication with the vent openings in the rail member as the armature vessel is moved along the rails, enclosing within the armature vessel means forming an electrically conductive gaseous material, applying electrical energy to the rail members, whereby electrical current flows through the rail members and through the electrically conductive gaseous material within the armature vessel when electrical energy is applied to the rail members, and whereby the armature vessel and the electrically conductive gaseous material therewithin travel along the rail members, and whereby pressure of the electrically conductive gaseous material within the armature vessel is controlled as portions of the electrically conductive gaseous material are exhausted from the armature vessel through the openings therein and through the vent apertures in at least one of the rail members as the armature vessel travels along the rail members.

11. The method of claim 10 which includes positioning a projectile between the rail members for movement of the projectile by the armature vessel as the armature vessel travels along the rail members.

12. A method of discharging a projectile comprising providing a pair of electrically conductive rail members, forming in at least one of the rail members a series of spaced-apart vent apertures, positioning the rail members in spaced-apart relationship, positioning between the rail members a vessel having an opening therein which communicates with the vent apertures, positioning within the vessel electrically conductive gaseous material means, applying electrical energy to the rail members, whereby electrical energy flows through the rail members and through the electrically conductive gaseous material means, and whereby the vessel is forced to travel along the rail members as electrical energy flows through the electrically conductive gaseous material means, and whereby portions of the gaseous material means flow from the vessel through the opening therein and through the vent apertures as the vessel travels along the rail members.

13. The method of claim 12 which includes positioning a projectile member between the rail members and adjacent the vessel for travel of the projectile member with travel of the vessel.

14. The method of claim 12 in which the opening in the vessel is of a given area and shape, and each of the vent apertures in the series thereof is of a given area, and the spacing between adjacent vent apertures in the series thereof is of a given spacing, whereby the pressure of the plasma within the vessel is maintained at a predetermined pressure as the vessel travels along the rail members.

15. The method of claim 12 in which the vent apertures in the series thereof are of a predetermined area and have a predetermined spaced-apart relationship, and in which the opening in the vessel is of a predetermined area and in a predetermined position, whereby the opening in the vessel is continuously in communication with the vent openings as the vessel travels along the rails.

16. A method of discharging a projectile by means of railgun structure which is provided with a pair of spaced-apart electrically conductive rail members, and in which an electrically conductive gaseous material is positioned between the rail members, and in which electrical energy is applied to the rail members and to the gaseous material for travel of the gaseous material along the rail members, comprising forming a series of vent apertures in at least one of the rail members, including selecting the area of the vent apertures and selecting the spacing between the vent apertures, and discharging portions of the gaseous material through the vent apertures as the gaseous material travels along the rail members.

17. A method of discharging a projectile by means of railgun structure which is provided with a pair of spaced-apart electrically conductive rail members, and in which an electrically conductive gaseous material is positioned between the rail members, and in which electrical energy is applied to the rail members and to the gaseous material for travel of the gaseous material along the rail members, comprising forming a series of vent apertures in at least one of the rail members, and discharging portions of the gaseous material through the vent apertures as the gaseous material travels along the rail members.

18. A method of discharging a projectile by means of railgun structure which is provided with a pair of spaced-apart electrically conductive rail members, and in which an armature vessel is positioned between the rail members, and in which an electrically conductive gaseous material is contained within the armature vessel, and in which electrical energy is applied to the rail members and to the gaseous material for travel of the armature vessel along the rail members, and in which gaseous pressure is created within the armature vessel, comprising forming a series of vent apertures in at least one of the rail members, including discharging portions of the gaseous material through the vent apertures as the armature vessel travels along the rail members, including controlling the gaseous pressure within the armature vessel to maintain pressure equilibrium within the armature vessel as the armature vessel travels along the rails.

19. Railgun structure comprising a gun bore which includes a pair of electrically conductive rails, an armature vessel positioned between the rails and movable along the rails, means within the armature vessel forming an electrically conductive gaseous material, means for applying electrical energy to the rails for forcing travel of the electrically conductive gaseous material and the armature vessel along the rails, the armature vessel including means for venting gaseous material from the armature vessel as the armature vessel travels along the rails, the gun bore including vent means extending along the rails for venting the electrically conductive gaseous material from the gun bore as the armature vessel travels along the rails, whereby the pressure of the electrically conductive gaseous material within the armature vessel and within the bore is controlled.

20. Railgun structure comprising a gun bore which includes a pair of electrically conductive rail members, means positioned between the rail members forming an electrically conductive gaseous material, means for applying electrical energy to the rail members for forcing travel of the electrically conductive gaseous material along the rails, the bore including vent means extending along the rail members for venting portions of the electrically conductive gaseous material from the bore as the electrically conductive gaseous material travels along the rails and within the gun bore, whereby the pressure of the electrically conductive gaseous material within the gun bore is controlled.

21. A method of producing railgun structure comprising providing gun bore structure which includes a pair of electrically conductive rail members, positioning between the rail members means forming an electrically conductive gaseous material, providing means for electrical energization of the rail members for travel of the electrically conductive gaseous material along the rail members and within the gun bore, providing the gun bore with vent means extending along the rail members for venting the electrically conductive gaseous material from the gun bore as the electrically conductive gaseous material travels along the rail members and within the bore, whereby the pressure of the electrically conductive gaseous material within the gun bore is controlled as the electrically conductive gaseous material travels along the rail members and within the gun bore.

* * * * *